US005162852A

United States Patent [19]

Ikeda

[11] Patent Number: 5,162,852

[45] Date of Patent: Nov. 10, 1992

[54] IMAGE FORMING APPARATUS HAVING EXCHANGEABLE DEVELOPING DEVICE

[75] Inventor: Masamichi Ikeda, Yokohama, Japan

[73] Assignee: Canon Kabushiki Kaisha, Tokyo, Japan

[21] Appl. No.: 398,532

[22] Filed: Aug. 25, 1989

[30] Foreign Application Priority Data

Aug. 31, 1988 [JP] Japan ..... 63-215053

[51] Int. Cl.[5] ..... G03G 15/06

[52] U.S. Cl. ..... 355/245; 355/200; 355/326

[58] Field of Search ..... 355/245, 200, 211, 210, 355/296, 326, 260, 327; 118/653; 126/340; 312/273

[56] References Cited

U.S. PATENT DOCUMENTS

| | | | |
|---|---|---|---|
| 3,466,105 | 9/1969 | Guth | 126/340 |
| 4,841,329 | 6/1989 | Kasamura et al. | 355/326 X |
| 4,916,490 | 4/1990 | Tanaka et al. | 355/245 |
| 4,922,300 | 5/1990 | Sasaki et al. | 355/245 |

FOREIGN PATENT DOCUMENTS

| | | | |
|---|---|---|---|
| 0271209 | 6/1987 | European Pat. Off. . | |
| 59-69764 | 10/1985 | Japan . | |
| 60-208779 | 10/1985 | Japan . | |
| 0020068 | 1/1986 | Japan | 355/245 |
| 0149655 | 6/1988 | Japan | 355/211 |

*Primary Examiner*—A. T. Grimley
*Assistant Examiner*—Robert Beatty

[57] ABSTRACT

An image forming apparatus in which a developing device for developing a latent image is exchangeable includes an opening for permitting mounting and dismounting of the developing device relative to a main assembly of the image forming apparatus, a path along which the developing device is movable between the opening and a predetermined position in the main assembly, a movable door for opening and closing the opening, and a device for mechanically coupling the door and developing device to move the developing device along the path in association with opening and closing action of the door.

13 Claims, 5 Drawing Sheets

IMAGE FORMING APPARATUS HAVING EXCHANGEABLE DEVELOPING DEVICE

FIELD OF THE INVENTION AND RELATED

The present invention relates to an image forming apparatus wherein a developing device for developing an electrostatic latent image is exchangeable.

There is an increasing demand for a color image forming apparatus. To meet this demand, various measures have been proposed. Several types of color image forming apparatuses are known. In a first type, a process cartridge containing a developing device alone or containing an image bearing member in the form of a photosensitive drum, cleaning device, charging device and a developing device as a unit, is detachably mountable into an image forming apparatus. In the second type, the image forming apparatus is equipped with two developing devices containing different color developers, which are selectively usable. In a third type, the image forming apparatus is equipped with a number of developing devices containing different color developers (what is called a full-color type), from which a desired developing device is selectable.

In the type using the process cartridge, an increase of the cartridge size is not convenient from the standpoint of operation of the cartridge itself, and therefore, it is not suitable for a large size and high speed image forming apparatus. In the third type, it is not taken into account that the developing device in the main assembly of the image forming apparatus is exchanged with a developing device containing a different color.

Referring first to FIG. 1, when the developing device in the main assembly is to be exchanged with a different color developing device, the operator has to insert the developing device into the main assembly. When the operator pushes by his hands a developing device into the main assembly along a passage 60, the developing device 13 becomes oblique in the passage 60 and is stuck with the passage walls 61 and 62. Thus, the operator has difficulty in properly setting the developing device 13 to a predetermined position 130. The same thing also occurs when the developing device is retracted from the predetermined position.

SUMMARY OF THE INVENTION

It is a principal object of the present invention to provide an image forming apparatus wherein the developing device can be set in the main assembly and can be retracted therefrom without difficulty.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
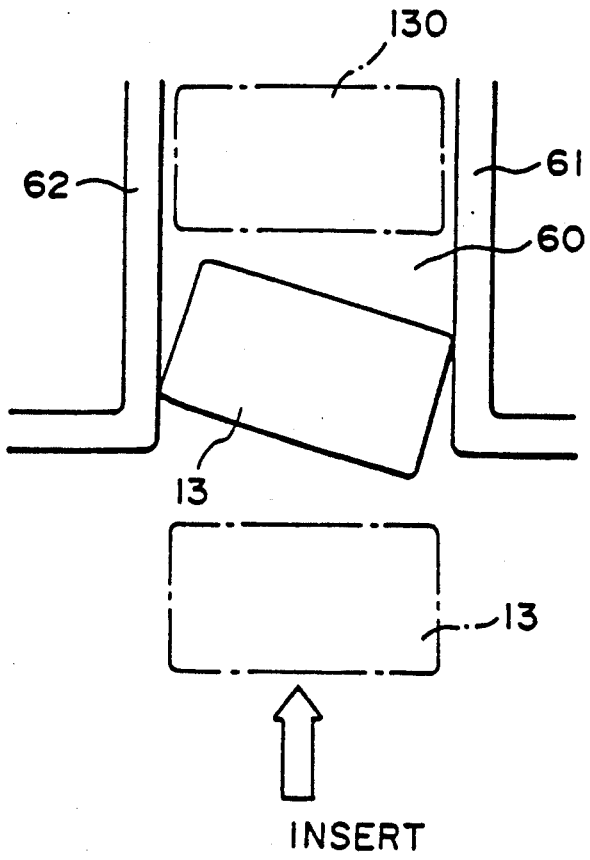
FIG. 1 (PRIOR ART)
FIG. 1 illustrates the developing device stuck against a wall of an image forming apparatus.
Figure 2:
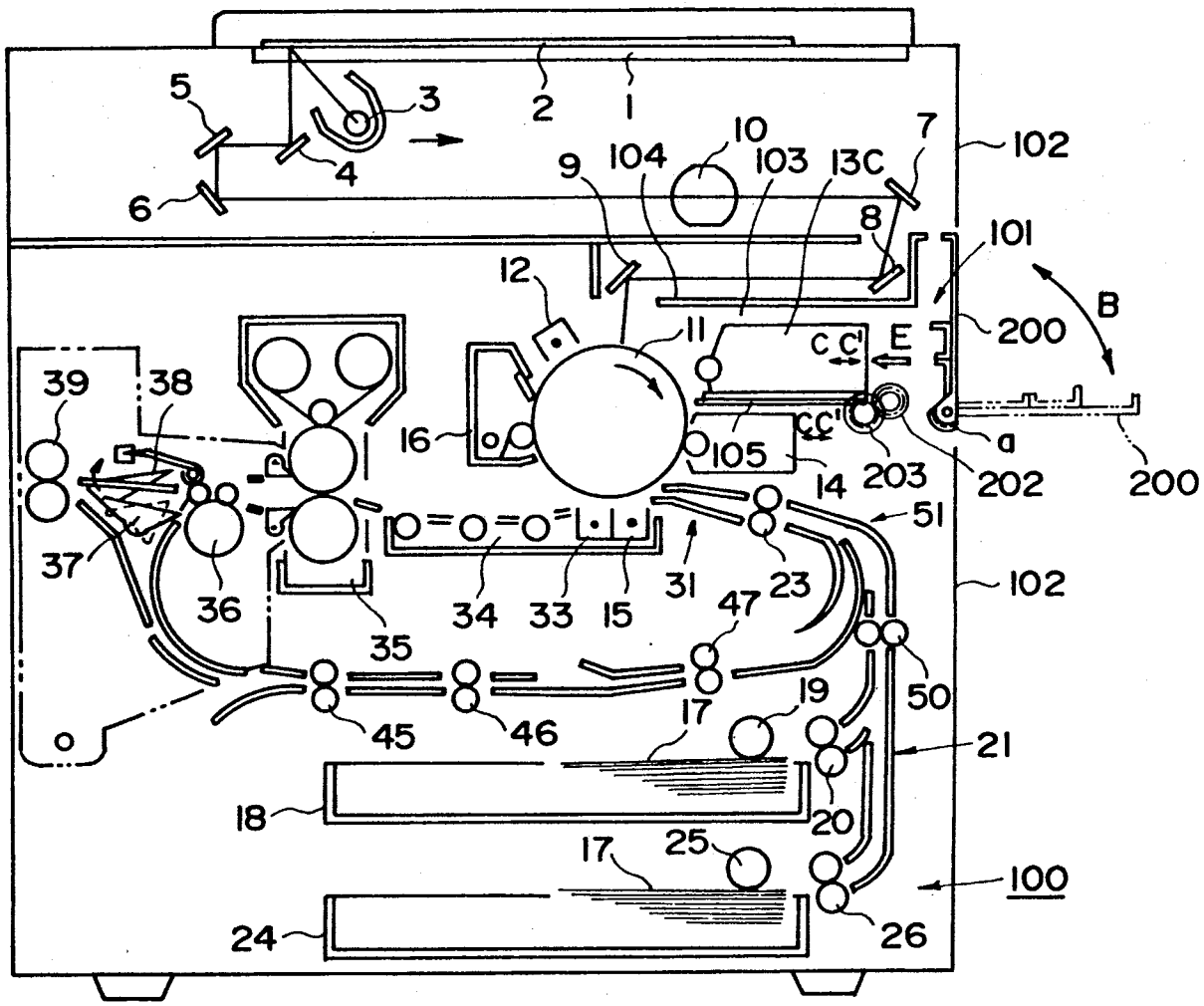
FIG. 2 is a sectional view of an image forming apparatus according to an embodiment of the present invention.

Referring to FIG. 2, there is shown an image forming apparatus according to an embodiment of the present invention. In this apparatus, an original 2 placed on an original supporting platen glass 1 is illuminated by a lamp 3. The reflected light image of the original is projected onto an electrophotographic photosensitive member (image bearing member) 11 through an optical system comprising reflection mirrors 4, 5, 6, 7, 8 and 9 and resume lens 10. The lamp 3, mirror 4, mirror 5 and mirror 6 are moved in the direction indicated by an arrow A at predetermined speeds to scan the original 2. The surface of the photosensitive drum 11 is uniformly charged by a primary charger 12 and is rotating in the direction indicated by an arrow B. Therefore, an electrostatic latent image corresponding to the original image is formed on the outer surface of the photosensitive drum 11. Around the photosensitive drum 11, there are disposed a chromatic developing device (green developing device 13C) containing color toner (green, for example) and a black developing device 14 containing black toner. Each of the developing devices 13C and 14 is movable in the direction indicated by an arrow C or C' between a stand-by position and a developing position where it supplies the toner to the drum to develop the latent image. One of the developing devices selected in accordance with a desired color of the image, is moved toward the photosensitive drum 11 in the direction indicated by arrow E to its developing position to develop the electrostatic latent image on the photosensitive drum 11. In the shown state, the chromatic color developing device (green developing device 13C) is away, and the black developing device 14 is close to the photosensitive drum, therefore, a black image is formed on the photosensitive drum 11. The image is transferred onto a transfer material (transfer sheet) 17 by a transfer charger 15. Thereafter, the surface of the photosensitive drum 11 reaches a cleaner 16 by which the residual toner on the outer periphery of the photosensitive drum is removed, so that the photosensitive member is subjected to the next image forming operation.

The transfer material 17 is accommodated in a cassette 18 or 24 and is fed out by a pick-up roller 19 or 25 to a pair of rollers 20 or 26. The pair of rollers 20 or 26 functions when two or more transfer sheets 17 are fed out, so that the topmost one of the transfer sheets 17 is separated out to be fed to the image forming means. The transfer sheet 17 after passing through the pair of rollers 20 or 26 reaches through a guide 21, a pair of conveying rollers 50 and a guide 51 to registration rollers 23.

The registration rollers 23 start to rotate so that the image developed on the photosensitive drum 11 is in alignment with the transfer material 17, and feed the transfer material 17 through a guide 31 to the outer surface of the photosensitive drum 11. As described hereinbefore, the image on the outer surface of the photosensitive drum 11 is transferred onto the transfer sheet 17 by the transfer charger 15. Then, the transfer sheet 17 is separated from the outer surface of the drum 11 by a separation charger 33, and is fed through the conveyance passage 34 into an image fixing device 35 comprising a heating roller and a pressing roller. The transfer material 17 is heated and pressed by the fixing device 35, by which the image on the transfer material 17 is fixed as a permanent image. Then, the transfer material 17 is conveyed to a first discharging roller 36, and is discharged to the outside of the apparatus through the flappers 37 and 38 by a second discharging roller 39. In this Figure, the flapper 38 blocks the transfer material passage. However, the flapper 38 is made of light material and is swingable in a direction D, so that when the transfer material 17 passes, it is raised by the leading edge of the transfer material 17 to be retracted. Therefore, it does not obstruct the passage of the transfer material 17.

The description will be made as to the flow of the transfer material 17 during the operations in the duplex image formation mode (images are formed on both sides of the transfer material 17) and in a superimposing image formation mode (images are superposed on one side of a transfer material). When the duplex mode is instructed in the image forming apparatus, the transfer material 17 is processed to have a transferred and fixed image of an original similar to the simplex image formation mode (an image is formed on one side of a transfer material 17) discussed hereinbefore. Then, it is conveyed to the second discharging rollers 39 and is discharged onto an unshown tray outside the apparatus. The trailing edge of the transfer material 17 is detected by a transfer material detecting mechanism comprising a detecting lever 40 and a photosensor 41. After a predetermined period of time passes (that is, the time required for the trailing edge transfer material 17 to pass by the flapper 38), the second discharging rollers 39 start reverse rotation to refeed the transfer material 17 into the apparatus. The transfer material 17 is moved back along the left inclined surfaces of the flappers 38 and 37 and along a guiding plate 42, and is further conveyed along the guiding plates 43 and 44, by which the transfer material is reversed in its facing orientation. Therefore, the transfer material is conveyed to the roller 45 with the second side facing up. Thereafter, the transfer material 17 is conveyed to a lateral registration roller 47 through a roller 46. At this time, the lateral registration roller 47 is not rotated. After the transfer material 17 completely abuts the roller 47, the pair of rollers 45 and 46 stop. By this, the transfer material 17 is held for the image forming operation corresponding to the second side image formation. When the image formation signal for the second side is produced, the lateral registration roller 47 starts to rotate to advance the transfer material 17 to the registration roller 23 along the guide plates 49 and 51. Prior to arrival of the transfer material 17 at the registration roller 23, the lateral edge of the transfer material 17 is detected by a photosensor not shown, and the lateral registration roller 47 moves in the direction perpendicular to the direction of movement of the transfer material 17, that is, perpendicularly to the sheet of the drawing to correct the lateral position of the transfer material 17 so that the lateral edge is at the same position as in the first side image formation. The operations after the transfer material 17 reaches the registration roller 23 are the same as in the one side image formation described hereinbefore. The transfer material 17 now having the image on the second side is finally discharged onto the tray outside the apparatus by the second discharging rollers 39.

When the superimposing image formation mode is instructed in the image forming apparatus, the first image forming operation is similar to the case of the one side image formation. After the first image formation, the flapper 37 takes the position indicated by broken lines. Therefore, the transfer material 17 is advanced by the first discharging roller 36 and is conveyed along the right-inclined surface of the flapper 37 to the guides 42 and 43, and further to the roller 45 along the guides 43 and 45. Thereafter, the transfer material 17 reaches the lateral registration roller 47 through the rollers 46. The trailing edge of the transfer material 17 is detected by a detecting lever 40 and a photosensor 41. When a predetermined period of time elapses, the flapper 37 is reset to the position indicated by the solid line. When the second image formation signal is produced, the lateral registration roller 47 starts to rotate. The movement of the transfer material at this time is similar to the case of the second side image formation in the duplex image formation mode. The transfer material 17 having been subjected to the second image forming operation is finally discharged onto the tray outside the apparatus by the second discharging rollers 39. In this embodiment, the two images are superposed, but the movement of the transfer material 17 is fundamentally the same when two or more images are superposed. It should be noted, however, that the resetting of the flapper 37 from the broken line position to the solid line position is effected prior to the final image formation.

The image for the backside of the transfer material may be formed in a color different from that of the first side image. Also, in the superimposing mode, the image to be transferred secondly on the side of the transfer material can be developed with a color different from that of the firstly transferred developed image.

In the apparatus of FIG. 2, the chromatic color developing device 13*c* is detachably mountable into the main assembly 100 of the image forming apparatus by the operator. Therefore, it is possible that the chromatic color developing device 13*c* is taken out of the main assembly 100, and then, a developing device containing different color toner can be set in the main assembly 100.

In order to allow the mounting and dismounting the developing device relative to the main assembly 100, an access opening 101 is formed in an outer casing 102. The opening 101 is provided with a door 200. The door 200 is hinged to the casing 102 by a shaft A at its bottom portion. Therefore, the door 200 is swingable about the shaft a in the direction indicated by an arrow B. The solid line shows the door 200 which closes the opening 101, while the chain line shows the door 200 opened.

A passage 103 is formed by plates 104 and 105 to guide the developing device 13*c* inserted into the main assembly 100 in the direction indicated by arrow E through the opening 101 to the stand-by position and to guide the same from the stand-by position to the opening 101. The plate 105 guides the developing device 13C in the passage 103.

Figure 3:
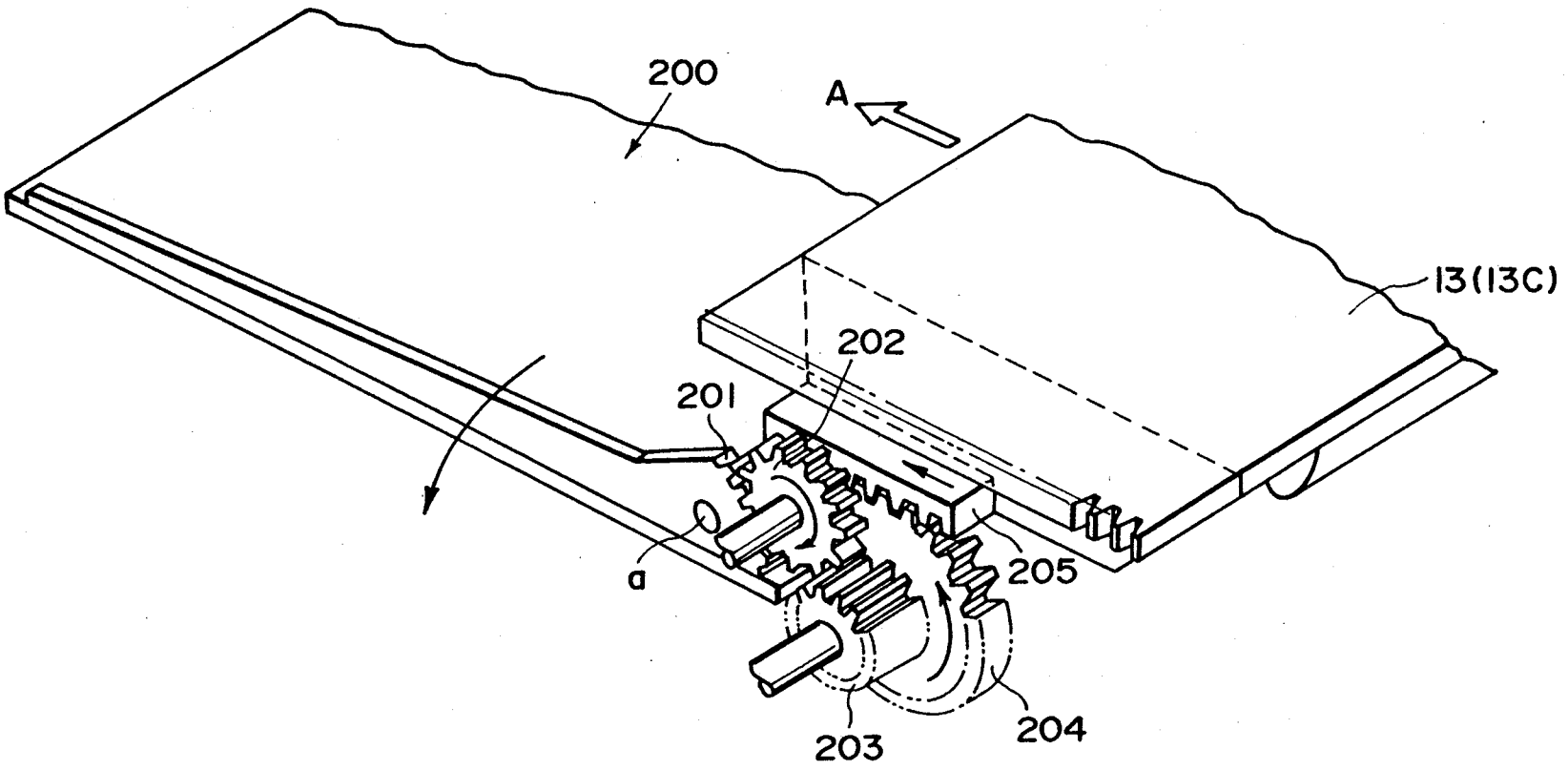
FIG. 3 is a perspective view of a major part of the image forming apparatus of FIG. 2.

Referring to FIG. 3, a sector gear 201 is integrally formed with the door 200 adjacent to the rotational central shaft a.

Adjacent to the door 200 and adjacent to the opening 101, a gear 202, a gear 203 meshed with the gear 202 and a gear 204 coaxial with the gear 203 are provided. The gear 204 is meshed with a rack 205 formed at a bottom of the color developing device 13.

Figure 4:
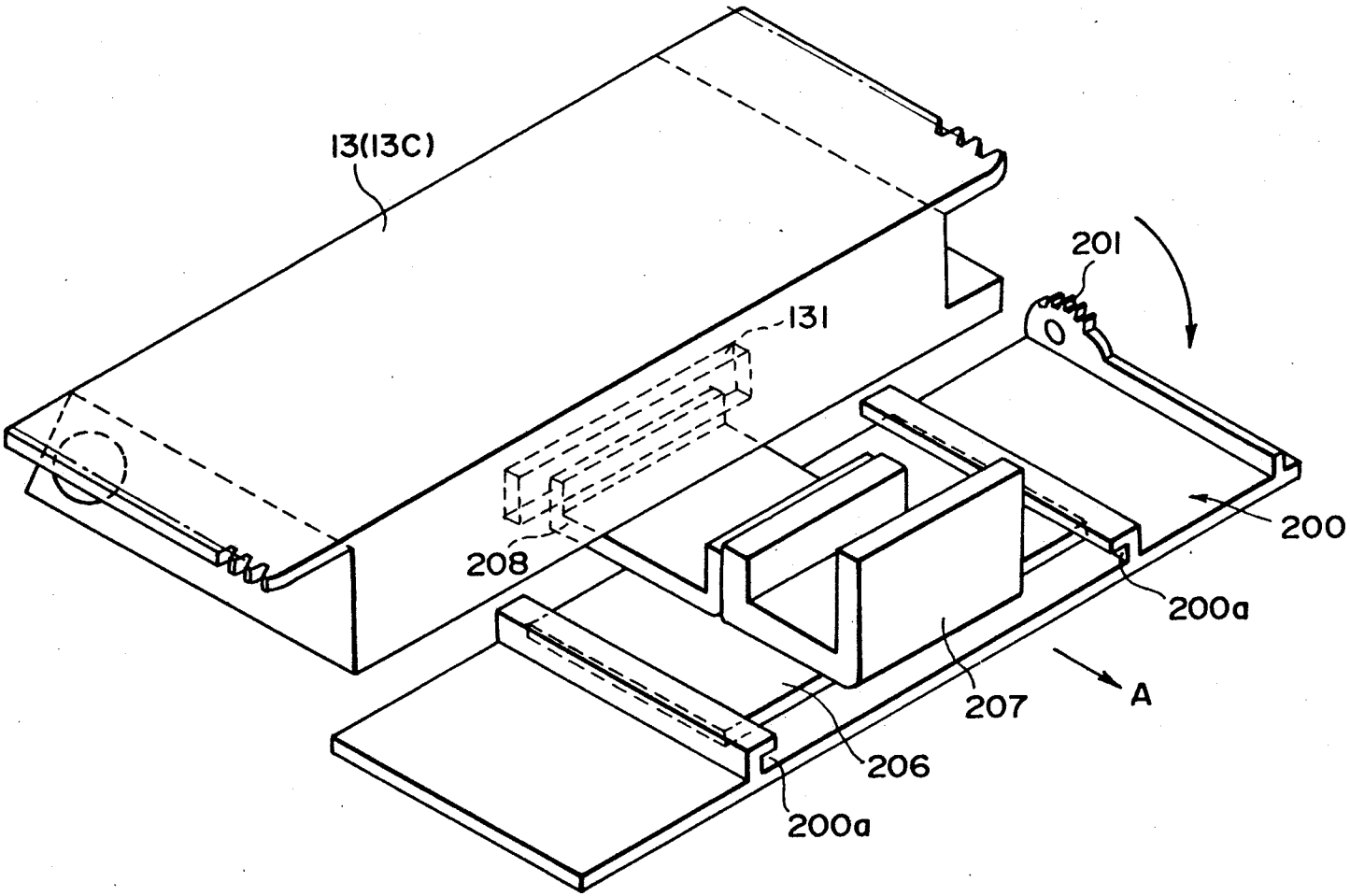
FIG. 4 is a perspective view of a major part of the image forming apparatus of FIG. 2.

As shown in FIG. 4, two elongated channels 200*a* and 200*a* are formed in parallel with each other, extending in the direction of the mounting and dismounting of the color developing device 13. With the channels 200*a* and 200*a*, a sliding member 206 in the form of a flat plate is engaged for sliding movement in the mounting and dismounting direction. The sliding member 206 is provided at its central position with a grip 207 and a hook 208 engageable with the developing device 13. The operation will be described when the operator retracts the color developing device 13 from the main assembly 100 to a position where it can be exchanged. First, the operator opens the door 200 manually in the direction shown in FIG. 3, then the sector gear 201 formed in the door 200 and rotates about the rotational axis a in the same direction, by which the gear 202 meshed with the sector gear 201 is rotated in the direction of the arrow. By the rotation of the gear 202, the gear 203 meshed with the gear 202 and the gear 204 coaxial with the gear 203 are rotated in the direction indicated. The rotation of the gear 204 linearly moves the rack 205 meshed therewith in the direction indication by an arrow in the Figure. As a result, the color developing device 13 having the rack 205 at its bottom portion is retracted out in the direction a in association with the opening operation of the door 200. When the door 200 is completely opened to the chain line position shown in FIG. 2, a part of the developing device is outside the opening 101, that is, outside the main assembly 100, and the color developing device 13 is brought to the position engageable with the hook 208. Also, at this time, the developing device is disengaged from electric contact provided in the main assembly 100 to supply a developing bias voltage to the developing device. Therefore, when the operator manually pulls the grip 207 in the direction A, the developing device 13 can be easily moved up to a position where it can be exchanged. Thus, the operatively is improved, and the work load on the operator is reduced.

Adjacent the bottom of the developing device 13, a recess 131 is formed for engagement with the hook 208. When the door 200 is rotated in the manner described in the foregoing, the hook 208 moves integrally with the door 200 so as to be engaged with the recess 101. By this, the hook 208 is engaged with the developing device at the recess 131.

By pulling the grip 207, the developing device is completely retracted from the main assembly 100 and is placed on the opened door 200. The developing device may be replenished with the toner, or it may be exchanged with another developing device.

When the developing device 13 is to be reset into the main assembly 100 after the developing device 13 is exchanged or after the developing device is replenished with the toner, the reverse operations are performed. More particularly, the operator pushes the grip 207 to bring the rack 205 thereof into meshing engagement with the gear 204. Then, the door 200 is manually closed, by which the gears rotate the opposite directions, and the developing device moves to the stand-by position along the passage 103. Since the hook 208 moves integrally with the door 200, it is disengaged from the recess 131 at a certain point of time during the upward rotation of the door 200.

Figure 5:
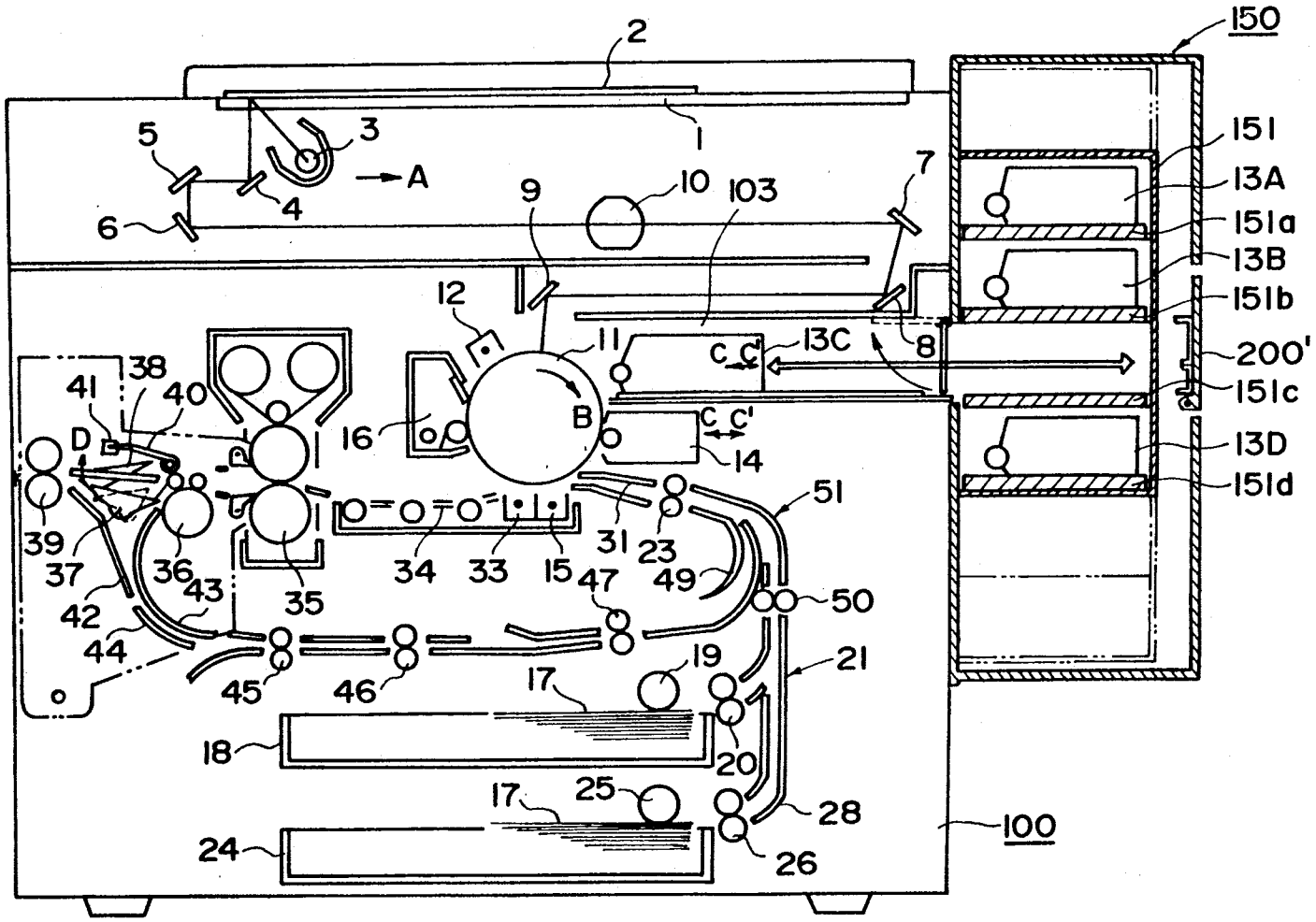
FIG. 5 is a sectional view of the image forming apparatus of FIG. 2 to which a plural developing device accommodating unit is attached.

Referring to FIG. 5, the description will be made as to the image forming apparatus having the main assembly 100 externally equipped with an optional developing device accommodating unit 150 for accommodating a plurality of the developing devices.

The developing device accommodating unit 150 is optionally attached to the main assembly of the image forming apparatus when a color formation is desired using one or more non-black color developing devices. From the accommodating unit 150, a desired color developing device is introduced into the main assembly 100 to the stand-by position in the neighborhood of the photosensitive drum 11.

The accommodating unit 150 includes therein an accommodating case 151 having partitions 151*a*, 151*b*, 151*c* and 151*d*. The partitions 151*a*, 151*b*, 151*c* and 151*d* carry chromatic color developing devices containing different color toners, respectively; for example, a red developing device 13A containing red toner, a blue developing device 13B containing blue toner, a green developing device 13C containing green toner and a brown developing device 13D containing brown toner. They are movable toward the main assembly 100. In the state shown in FIG. 5, the green developing device 13C is not in the accommodating case 151, and is placed in the neighborhood of the photosensitive drum 11 in the main assembly 100 and is prepared for developing the latent image.

The accommodating case 151 is substantially vertically movable to bring vacant one of the partitions into alignment with the passage 103 for receiving the developing device set in the main assembly. Similarly, the accommodating case 151 is movable to bring one of the partitions carrying the developing device which is desired to be introduced into the main assembly, into alignment with the passage 103. The mechanism for the vertical movement of the case 151 and the mechanism for the horizontal movement of the developing devices may be as disclosed in U.S. Ser. No. 289,521, U.S. Pat. No, 4,841,329, EP266946A and EP271,209A.

In the apparatus of FIG. 5, the accommodating case 151 moves up and down, and therefore, it is not practical to mount, on the accommodating unit 150, the door 200 provided on the main assembly 100 side (FIG. 2) and the gears 202, 203 and 204 which is also provided on the main assembly side to constitute a mechanism for mechanically coupling the developing device 13. Therefore, in this case, when the developing device is to be taken out of the accommodating unit 150, the color developing device 13 is moved by an electric motor to a position before the door 200 thus, and thereafter, the door 200' is opened, by which the hook 208 (FIG. 4) of the door 200' is engaged with the developing device 13. Then, the grip 207 of the door 200' is pulled. By doing so, the color developing device 13 is easily taken out of the apparatus with good operativity.

As described, the present invention is particularly suitable to an image forming apparatus which is optionally capable of being equipped with a developing device accommodating unit 150 for accommodating a plurality of developing devices automatically exchangeable with the developing device in the main assembly 100, and which, however, is not loaded with the accommodating unit 150.

While the invention has been described with reference to the structures disclosed herein, it is not confined to the details set forth and this application is intended to cover such modifications or changes as may come within the purposes of the improvements or the scope of the following claims.

What is claimed is:

1: An image forming apparatus wherein a developing device for developing a latent image is exchangeable, comprising:

a movable door for opening and closing an opening for permitting mounting and dismounting of the developing device relative to a main assembly of the image forming apparatus;

a path along which the developing device is movable through the opening between a first predetermined position in the main assembly and a third predetermined position outside the main assembly, said path including a second predetermined position between the first and third predetermined positions;

means for mechanically coupling said door and the developing device to move the developing device between the first and second predetermined position along the path in association with an opening and closing action of said door; and manual operation means manually operable, while said door is opened, to move reciprocatingly the developing device between the second and third predetermined positions, said manual operating means comprising a manually movable member engageable with the developing device in associated with the opening action of said door.

2. An apparatus according to claim 1, wherein said coupling means includes a drive transmission member engageable with a driving force receiving portion of the developing device and a driving force applying member, provided in the door, to drive the drive transmission member in association with the opening and closing action of said door.

3. An apparatus according to claim 1, wherein said coupling means includes a first gear meshable with a rack of the developing device and a second gear provided in said door to rotate the first gear in association with the door opening and closing action.

4. An apparatus according to claim 1, 2 or 3, wherein said door is provided with a supporting portion for movably supporting said operating means.

5. An apparatus according to claim 4, wherein said door is rotatably mounted on the main assembly of said image forming apparatus at its bottom portion, and wherein the developing device is brought above the door by manual operation of said operating means.

6. An image forming apparatus wherein a developing device for developing a latent image is exchangeable, comprising:

a movable door for opening and closing an opening for permitting mounting and dismounting of the developing device relative to a main assembly of the image forming apparatus;

a path along which the developing device is movable between the opening and predetermined position in the main assembly; and movable manual operating means manually operable, while said door is opened, to mount the developing device into the main assembly and dismount it from the main assembly through said opening, said movable manual operating means comprising a hook, movable in association with opening and closing action of said door toward and away from a portion of the developing device which is engageable with said hook, and a grip connected to said hook and manually operable, while said door is opened, to move said hook engaged with the developing device toward the inside of the main assembly and toward the outside of the main assembly.

7. An apparatus according to claim 6, wherein said movable door is rotatably mounted on the main assembly at its bottom portion, and wherein said manual operating means is provided on a face of said door as to be faced to said path when said door is closed, and by which the developing device is brought above the door when it is opened.

8. An apparatus according to claim 1, wherein said movable door is rotatable, and said coupling means includes motion converting means for converting rotational motion of said door to a linear motion for moving said developing device.

9. An apparatus according to claim 1, wherein the developing device moves from the first predetermined position to said second predetermined position in association with opening of said door, and the developing device moves from said second predetermined position to said first predetermined position in association with closing of said door.

10. An apparatus according to claim 1, wherein said first predetermined position is a stand-by position.

11. A developing device accommodating apparatus for being mounted to an image forming apparatus, comprising:

a plurality of the developing devices;

supporting means for supporting said developing devices;

a movable door for opening and closing an opening for permitting mounting and dismounting of one of the developing devices relative to the supporting means; and movable manual operating means manually operable, while said door is opened, to mount the developing device into the supporting means and dismount it from the supporting means through said opening, said movable manual operating means comprising a hook, movable in association with opening and closing action of said door, toward and away from a portion of the developing device which is engageable with said hook, and a grip connected to said hook and manually operable, while said door is opened, to move said hook engaged with the developing device toward the inside of the supporting means and toward the outside of the supporting means.

12. An apparatus according to claim 11, wherein said supporting means is linearly movable.

13. An apparatus according to either claim 11 or 12, wherein said plurality of the developing devices contain different color developers.

* * * * *

UNITED STATES PATENT AND TRADEMARK OFFICE

CERTIFICATE OF CORRECTION

PATENT NO. : 5,162,852

DATED : Masamichi IKEDA

INVENTOR(S) : November 10, 1992

It is certified that error appears in the above-identified patent and that said Letters Patent is hereby corrected as shown below:

On the title page, Item [56]:

under *Assisstant Examiner* - Robert Beatty, insert:
--*Attorney, Agent, or Firm* - Fitzpatrick, Cella, Harper & Scinto--.

COLUMN 4:

line 45, "A" should read --a--.

COLUMN 5:

line 21, "a" should read --A--.

Signed and Sealed this

Twenty-eighth Day of December, 1993

Bruce Lehman

*Attest:*

BRUCE LEHMAN

*Attesting Officer*

*Commissioner of Patents and Trademarks*